United States Patent [19]

Anderson

[11] 4,208,608

[45] Jun. 17, 1980

[54] LAMP MOUNT STRUCTURE

[75] Inventor: Harold G. Anderson, Kirtland, Ohio

[73] Assignee: General Electric Company, Schenectady, N.Y.

[21] Appl. No.: 885,637

[22] Filed: Mar. 13, 1978

[51] Int. Cl.[2] ..... H01J 1/94; H01J 19/48; H01K 1/18

[52] U.S. Cl. ..... 313/279; 313/271; 313/274

[58] Field of Search ..... 313/271, 274, 279

[56] References Cited

U.S. PATENT DOCUMENTS

| | | | |
|---|---|---|---|
| 1,600,563 | 9/1926 | Proctor | 313/279 |
| 2,910,611 | 10/1959 | Jordan et al. | 313/279 |
| 3,270,238 | 8/1966 | Mosby | 313/279 |

*Primary Examiner*—Saxfield Chatmon, Jr.
*Attorney, Agent, or Firm*—Lawrence R. Kempton

[57] ABSTRACT

A simplified lamp mount structure is disclosed in which one end of the filament is attached to the apex of a loop with the free ends of the loop embedded in glass. The other end of the filament is attached to a conventional inner lead wire.

4 Claims, 4 Drawing Figures

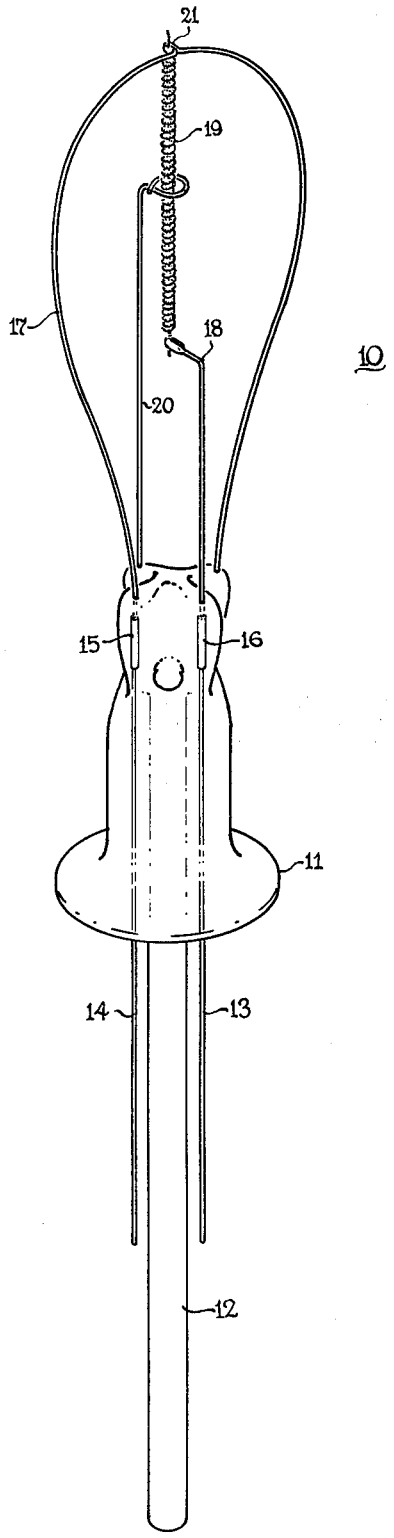
21
19
17
18
10
20
15
16
11
14
13
12

LAMP MOUNT STRUCTURE

This invention relates to electric lamps and, in particular, to the structure of a mount for use in making electric lamps.

As known by those in the lampmaking art, the lamp mount provides two critical functions: to provide a conductive path between the light source enclosed within the envelope and the outside world and to adequately support the filament. These basic mechanical and electrical requirements, in turn, spawn a host of interrelated factors which must always be considered against the background of the manufacturability of the lamp.

The prior art contains many proposed designs for lead wires, some of which are practical, all of which leave something to be desired. For example, a mount structure presently in use comprises what is known as a button having support and tie-wires embedded therein. These wires are wrapped around the filament and inner lead wires, respectively.

While enabling a lamp which adequately resists shock, the number and complexity of the manufacturing steps associated with the button adds to the cost of the lamp, both directly in terms of materials and directly in terms of equipment. Thus, the goal, in general, is to simplify mount construction without reducing the shock resistance characteristics of the lamp.

For what is known in the art as a CC-8mount, ie. with the filament parallel to the axis of the lamp, the problem of shock resistance is increased due to the length of the lead wire going to the end of the filament farther from the base of the lamp. Ignoring the weight of the lead itself, the weight/force of the filament acts through a longer moment arm than with the other lead wire. The increased stress increases the chance that the longer lead will bend, usually at the point where the lead exits the glass.

One prior art approach to this particular problem has been to increase the length of the dumet segment of the longer lead wire when the tie wires are eliminated. While there are other considerations, the cost of the increased length of dumet required by this approach is not insignificant.

In view of the foregoing, it is therefore an object of the present invention to provide a simplified mount structure.

Another object of the present invention is to provide a mount structure which is practical for mass production.

A further object of the present invention is to provide a simplified mount structure at least equal to current designs in terms of shock resistance.

Another object of the present invention is to provide an improved mount comprising a looped inner lead wire.

A further object of the present invention is to provide an improved CC-8mount.

The foregoing objects are achieved in the present invention wherein there is provided a loop of inner lead wire having the free ends thereof embedded in glass. The upper end of the filament is attached at approximately the apex or center of the loop, while the lower end of the filament is attached to a short lead wire.

A more complete understanding of the present invention can be obtained by considering the following detailed description in conjunction with the accompanying drawings, in which:

The FIGURE illustrates a preferred embodiment of the present invention.

Referring to the FIGURE, a mount in accordance with the present invention comprises a flare 11 having an exhaust tube 12 and lead wires 13 and 14 positioned therein. Lead wires 13 and 14 have a central section 15 and 16 comprising dumet for matching the temperature coefficient of expansion above the glass. Inner leads 17 and 18 are attached to the dumet section and emerge from the glass as illustrated in the FIGURE. Mounts in accordance with the present invention, since a button is not required, use a shorter exhaust tube which is terminated in the upper portion of flare 11. The particular geometry of the upper portion of flare 11 where the exhaust tube terminates is not critical, except that it provide a sufficient mass of glass in which to insert the lead for support wires. Inner lead 17 is curved to form a loop so that the free ends of the inner lead are embedded in glass, as illustrated in the FIGURE. Filament 19 is attached between the shorter inner lead 18 and the approximate mid-point or apex of inner lead 17. The upper end of filament 19 is suitably attached to the apex of the loop, eg. by way of a clamp 21 formed at the approximate mid-point of inner lead 17. Surrounding, but preferably not in contact with filament 19, is support wire 20 having a loop in one end thereof encircling the approximate mid-point of filament 19 and having the other end thereof embedded in the glass at the upper end of flare 11.

As thus constructed, a mount in accordance with the present invention provides a stiffer support for the upper end of CC-8 filament 19. Further, since the button and associated wires are eliminated, the manufacture of mounts in accordance with the present inventon is simplified.

Having thus described the invention it will be apparent to those of skill in the art that various modifications can be made within the spirit and scope of the present invention. For example, the multi-lobe geometry illustrated in the FIGURE for the upper portion of flare 11, while conserving glass, is not the only geometry suitable for use in the present invention. Further, while illustrated as comprising an incandescent filament as the light source, other suitable light sources may be used instead.

What I claim as new and desire to secure by U.S. Letters Patent is:

1. A lamp mount comprising: first and second inner lead wires, said first inner lead wires being longer than the other;

first and second lead out wires;

a flare in which one end of eahc of said first and second inner lead wires is embedded and is electrically connected to one of said lead out wires which exit the flare for connection to a power source said first inner lead wire being curved in a loop and having the other end thereof embedded and terminating in said flare; and a light source having one end attached to said first inner lead wire approximately at the middle thereof and having the other end thereof attached to the free end of said second inner lead wire.

2. The lamp mount as set forth in claim 1 wherein said light source comprises an incandescent filament.

3. The lamp as set forth in claim 2 wherein said lead wires each have a hook formed therein and said filament is attached by said hooks closed around the ends thereof.

4. The lamp mount as set forth in claim 3 and further comprising a support wire having one end embedded in said flare and the other end thereof encircling said filament.

* * * * *